US009309709B2

(12) United States Patent
DeNormand et al.

(10) Patent No.: US 9,309,709 B2
(45) Date of Patent: Apr. 12, 2016

(54) WINDOW COUNTERBALANCE SYSTEM

(71) Applicant: Caldwell Manufacturing Company North America, LLC, Rochester, NY (US)

(72) Inventors: Richard S. DeNormand, Victor, NY (US); Eric Rodems, Spencerport, NY (US); Jay Sofianek, Webster, NY (US); Robert M. Lucci, Rochester, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 14/215,714

(22) Filed: Mar. 17, 2014

(65) Prior Publication Data

US 2014/0259936 A1 Sep. 18, 2014

Related U.S. Application Data

(60) Provisional application No. 61/788,392, filed on Mar. 15, 2013.

(51) Int. Cl.
*E05D 13/00* (2006.01)
*E05D 15/22* (2006.01)

(52) U.S. Cl.
CPC ..... *E05D 13/1276* (2013.01); *E05D 15/22* (2013.01)

(58) Field of Classification Search
CPC ..... E06B 3/32; E06B 3/38; E06B 3/44; E06B 3/4407; E05D 13/08; E05D 13/1253; E05D 13/1276; E05D 15/16; E05D 15/22
USPC ..... 49/445, 447
See application file for complete search history.

(56) References Cited

U.S. PATENT DOCUMENTS

| | | | | |
|---|---|---|---|---|
| 4,068,406 | A * | 1/1978 | Wood | E05D 13/1207 49/181 |
| 6,119,398 | A * | 9/2000 | Yates, Jr. | 49/181 |
| 6,378,169 | B1 * | 4/2002 | Batten et al. | 16/197 |
| 6,886,295 | B2 * | 5/2005 | Annes et al. | 49/181 |
| 7,966,770 | B1 | 6/2011 | Kunz | |
| 8,371,068 | B1 * | 2/2013 | Kunz | E05D 13/08 16/193 |
| 8,464,466 | B1 | 6/2013 | Kunz | |
| 2004/0163209 | A1 | 8/2004 | Pettit | |
| 2005/0188620 | A1 * | 9/2005 | Malek et al. | 49/181 |
| 2008/0236046 | A1 * | 10/2008 | Tuller | 49/181 |

* cited by examiner

*Primary Examiner* — Katherine Mitchell
*Assistant Examiner* — Catherine A Kelly
(74) *Attorney, Agent, or Firm* — Harness, Dickey & Pierce, P.L.C.

(57) ABSTRACT

A window balance assembly for a tilt-in window comprising a bracket, a spring and a carrier. The first spring has a first portion engaging the bracket. The carrier has a vertical portion including a first slot, a first projection extending outwardly from a first side of the vertical portion, and a second attachment projection extending outwardly from a second side of the vertical portion. The first slot receives a pivot bar of the tilt-in window via a vertical drop-in installation. One of the first and second attachment protrusions engages the first portion of the spring. The horizontal portion includes an aperture rotatably engaging a cam between a first position and a second position. The cam has a second slot aligned with the first slot when the cam is in the first position allowing for the pivot bar to move between the first slot and the second slot.

16 Claims, 13 Drawing Sheets

WINDOW COUNTERBALANCE SYSTEM

CROSS-REFERENCE TO RELATED APPLICATIONS

This application claims the benefit of U.S. Provisional Application No. 61/788,392 filed on Mar. 15, 2013. The entire disclosure of the above application is incorporated herein by reference.

FIELD

The present disclosure relates to a window counterbalance system, and more particularly, to a window counterbalance system for a tilt-in window.

BACKGROUND

This section provides background information related to the present disclosure and is not necessarily prior art.

Modern window assemblies in residential, commercial and industrial buildings may include one or more window sashes that are movable within a window jamb. Window sashes that move vertically to open and close often include two or more window balance assemblies. The window balance assemblies urge the window sash upward (i.e., toward an open position for a lower sash or toward a closed position for an upper sash) to assist a user in moving the window sash and to retain the window sash at a position selected by the user.

SUMMARY

This section provides a general summary of the disclosure, and is not a comprehensive disclosure of its full scope or all of its features.

In one form, the present disclosure provides a window balance assembly for a tilt-in window installed in a window jamb channel. The window balance assembly comprises a bracket, a first spring and a carrier. The first spring has a first curled portion and a first free portion, the first curled portion engaging the bracket. The carrier comprises a vertical portion and a horizontal portion. The vertical portion includes a first slot extending vertically along a longitudinal axis of the vertical portion, a first attachment projection extending outwardly from a first side of the vertical portion, and a second attachment projection extending outwardly from a second side of the vertical portion that is opposite the first side of the vertical portion. The first slot is configured to receive a pivot bar of the tilt-in window via a vertical drop-in installation when the window balance assembly is installed in the window jamb channel. One of the first and the second attachment projections engage the first free portion of the first spring. The horizontal portion includes an aperture rotatably engaging a cam between a first position and a second position. The cam has a second slot aligned with the first slot of the vertical portion when the cam is in the first position allowing for the pivot bar to move between the first slot and the second slot.

In some embodiments, the vertical portion and the horizontal portion cooperate to generally form a T-shape.

In some embodiments, the first slot extends between the first and second projections.

In some embodiments, the first and second attachment projections extend vertically downward toward the horizontal portion such that distal ends of the first and second attachment projections are disposed vertically between the horizontal portion and proximal ends of the first and second attachment projections that are connected to the vertical portion.

In some embodiments, the horizontal portion includes a third slot extending horizontally along a longitudinal axis of the horizontal portion. The third slot receives a lock therein configured to engage the window jamb channel when the cam is in the first position to restrict the carrier from moving vertically in the window jamb channel.

In some embodiments, the lock includes a center member interconnecting a first member and a second member. The first member has a first outer surface and the second member having a second outer surface. The center member is configured to expand as the cam moves into the first position such that the first and the second members move apart from one another and the first and the second outer surfaces engage the window jamb channel to restrict the carrier from moving vertically in the window jamb channel. The center member is further configured to resiliently contract as the cam moves into the second position such that the first and the second members move towards one another to allow the carrier to move vertically in the window jamb channel.

In some embodiments, the first outer surface includes a first cavity receiving a first insert therein. The first insert engages a first wall of the window jamb channel when the lock is in the first position. The second outer surface includes a second cavity receiving a second insert therein. The second insert engages a second wall of the jamb channel when the lock is in the first position.

In some embodiments, the window balance assembly further comprises a second spring having a second curled portion and a second free portion. The second curled portion of the second spring engages the bracket and the second free portion of the second spring engages one of the first and the second attachment protrusions.

In another form, the present disclosure provides a counterbalance assembly for a tilt-in window having a pivot bar, the counter balance assembly and the tilt-in window installed in a window jamb having a jamb channel, the counter balance assembly comprising a bracket fixedly mounted to the jamb channel, a first spring having a first portion and a second portion, the first portion of the first spring coupled to the bracket, and a carrier assembly. The carrier assembly comprises a vertically extending first slot, an aperture in communication with the vertically extending slot, a cam having a rotational axis and rotatably engaging the aperture, and a first projection. The vertically extending first slot is configured to receive the pivot bar of the tilt-in window via a vertical drop-in installation. The cam is rotatable within the aperture between a locked position and an unlocked position. The cam having a second slot that is aligned with the vertically extending first slot when the cam is in the locked position allowing the pivot bar to move between the vertically extending first slot and the second slot of the cam. The first projection being at least partially vertically aligned with the aperture. The first projection engaging the second portion of the first spring.

In some embodiments, the second slot of the cam includes a longitudinal axis that is substantially collinear with a longitudinal axis of the vertically extending first slot when the cam is in the locked position.

In some embodiments, the vertically extending first slot includes a portion that is disposed at an angle relative to a longitudinal axis of the second slot when the cam is in the locked position.

In some embodiments, a distal end of the first projection includes a lip that is vertically aligned with the aperture.

In some embodiments, the carrier assembly includes a carrier body having a vertically extending portion and a horizontally extending portion that cooperate to generally form a T-shape. The vertically extending first slot is disposed in the vertically extending portion. The aperture is disposed in the horizontally extending portion.

In some embodiments, the carrier assembly includes a second projection that is at least partially vertically aligned with the aperture and is configured to engage the spring.

In some embodiments, distal ends of the first and second projections define a gap therebetween, and wherein the longitudinal axis of the second slot extends through the gap when the cam is in the locked position.

In some embodiments, the first and second projections extend laterally outward away from each other and away from a vertically extending portion of the carrier assembly, wherein the vertically extending first slot is disposed in the vertically extending portion and between the first and second projections.

In some embodiments, the longitudinal axis of the second slot of the cam is misaligned with the vertically extending slot when the cam is in the unlocked position, thereby restricting the pivot bar from moving between the vertically extending first slot and the second slot of the cam when the cam is in the unlocked position.

In some embodiments, the carrier assembly includes a second projection that is at least partially vertically aligned with the aperture. One of the first projection and the second projection engaging the second portion of the first spring.

In some embodiments, the carrier assembly further includes a horizontally extending slot disposed perpendicular to the vertically extending slot and in communication with the vertically extending slot. The horizontally extending slot receiving a lock that is configured to engage the jamb channel when the cam is in the locked position to restrict the carrier assembly from moving vertically in the window jamb channel.

In some embodiments, the lock includes a center member interconnecting a first member and a second member. The first member has a first outer surface and the second member has a second outer surface. The center member is configured to expand as the cam is moved into the locked position such that the first and the second members move apart from one another and the first and the second outer surfaces engage the jamb channel to restrict the carrier assembly from moving vertically in the jamb channel. The center member is further configured to resiliently contract as the cam is moved into the unlocked position such that the first and the second members move towards one another and the first and the second outer members to allow the carrier assembly to move in the jamb channel.

In some embodiments, the first outer surface includes a first cavity receiving a first insert therein. The first insert engages a first wall of the jamb channel when the cam is in the locked position. The second outer surface includes a second cavity receiving a second insert therein. The second insert engages a second wall of the jamb channel when the cam is in the locked position.

In some embodiments, the carrier assembly includes a second spring having a third portion and a fourth portion. The third portion of the second spring engages the bracket and the fourth portion of the second spring engages the first projection of the carrier assembly.

In some embodiments, the carrier assembly includes a removable insert engaging the vertically extending first slot, the removable insert restricting the pivot bar from moving between the vertically extending first slot and the second slot of the cam when the cam is in the locked position.

In yet another form, the present disclosure provides a window counterbalance system for a tilt-in window having a pivot bar, the window counterbalance system and the tilt-in window installed in a window jamb, the window counterbalance system comprises: a bracket fixedly mounted to the jamb channel, a first spring having a first portion and a second portion, the first portion of the first spring coupled to the bracket, and a carrier assembly. The carrier assembly has a vertically extending slot, an aperture in communication with the vertically extending slot, a cam having a rotational axis and rotatably engaging the aperture, a first projection, and a second projection. The vertically extending slot is adapted to receive the pivot bar of the tilt-in window via a vertical drop-in installation. The cam is configured to rotate within the aperture between a locked position and an unlocked position. The cam has a second slot in communication with the vertically extending slot when the cam is in the locked position to allow the pivot bar to move between the vertically extending slot and the second slot of the cam. The first projection has a first distal end and the second projection having a second distal end. The first and the second distal ends face one another and form a gap therebetween. The gap is vertically aligned with the rotational axis of the cam. One of the first and second projections engaging the second portion of the spring.

In some embodiments, the second slot of the cam is misaligned with the vertically extending slot when the cam is in the unlocked position, thereby restricting the pivot bar from moving between the vertically extending slot and the second slot of the cam when the cam is in the unlocked position.

In some embodiments, the carrier assembly includes a horizontally extending slot disposed perpendicular to the vertically extending slot. The horizontally extending slot is in communication with the vertically extending slot. The horizontally extending slot receiving a lock therein. The lock is configured to engage the window jamb when the cam is in the locked position to restrict the carrier from moving vertically in the window jamb.

In some embodiments, the lock includes a first member and a second member. The first member includes a first friction insert received therein and the second member includes a second friction insert received therein. The first friction insert and the second friction insert engaging the window jamb when the cam is in the locked position to restrict the carrier from moving vertically in the window jamb channel.

In some embodiments, the carrier assembly includes a second spring having a third portion and a fourth portion. The third portion of the second spring engages the bracket, and the fourth portion of the second spring engages one of the first and second projections of the carrier assembly.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
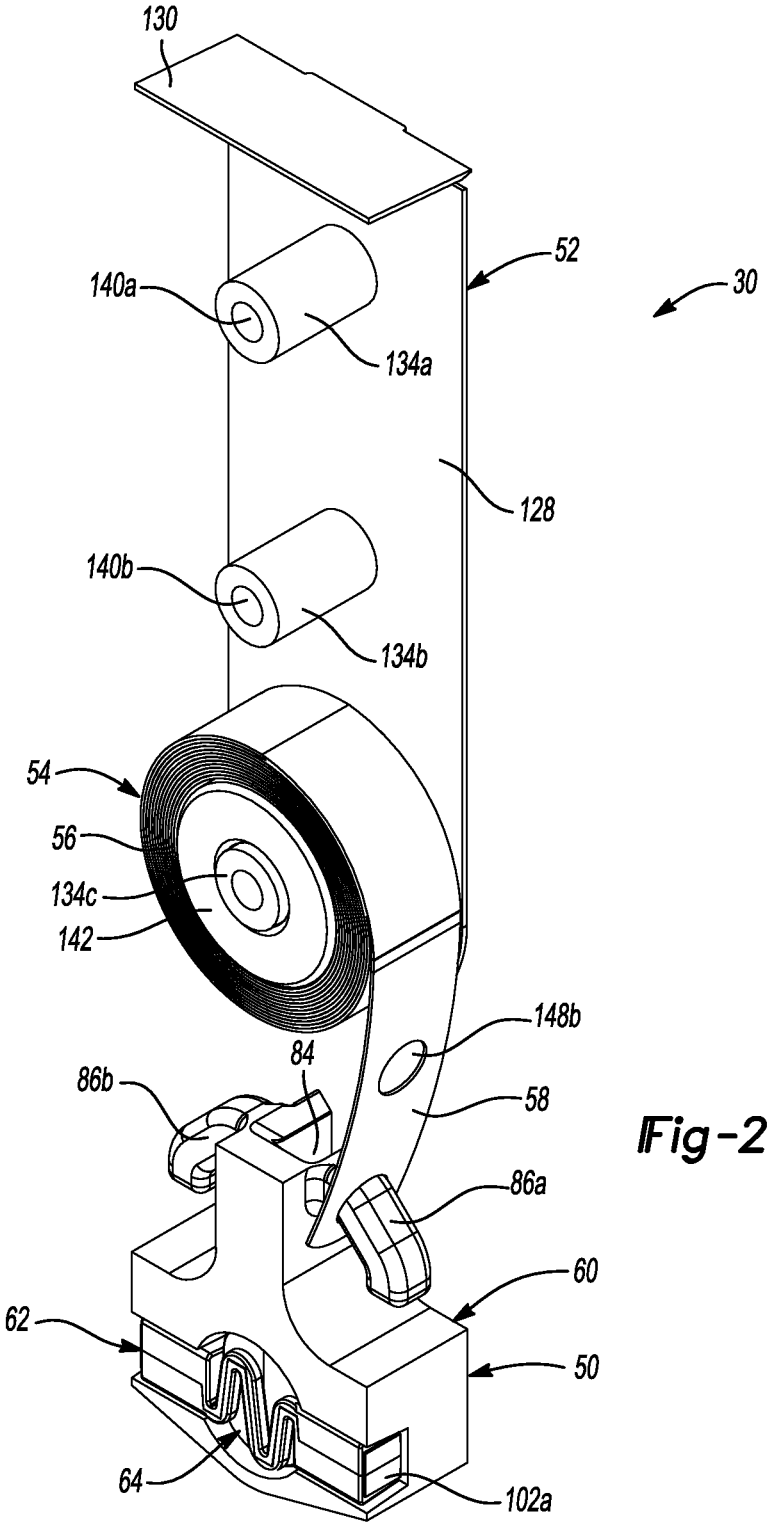
FIG. 2 is a perspective view of one of the window balance assemblies of FIG. 1.
Figure 5:
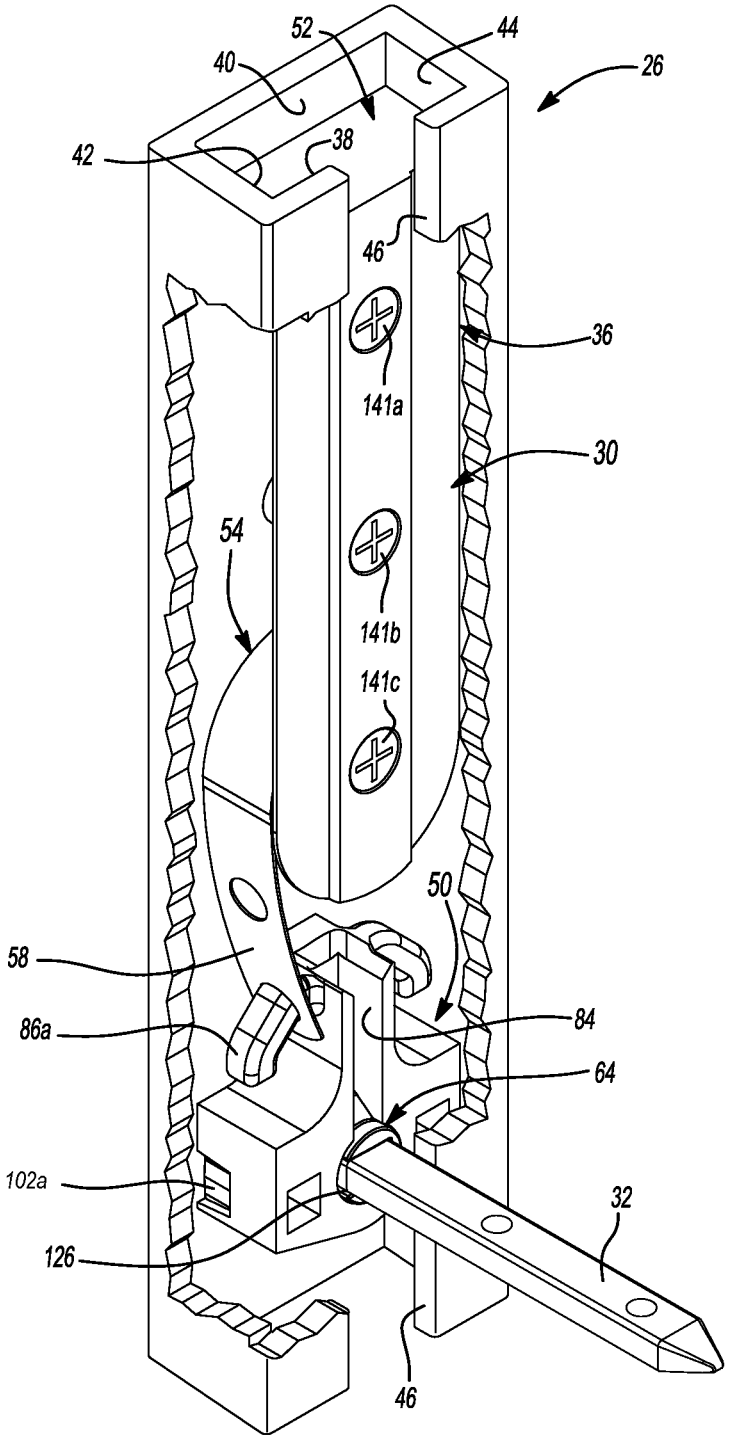
Figure 6:
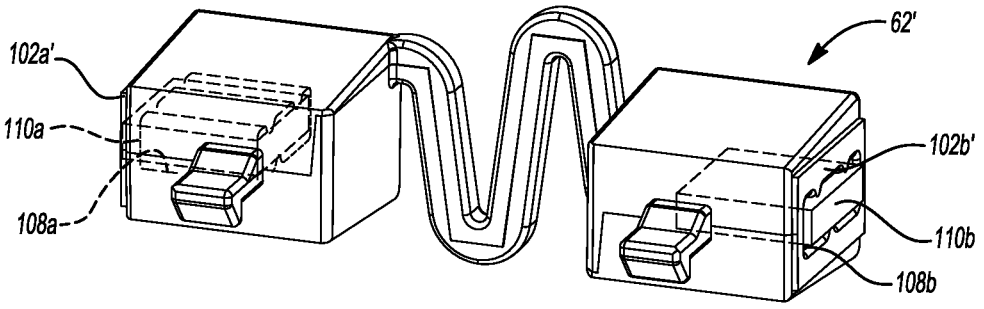
Figure 7:
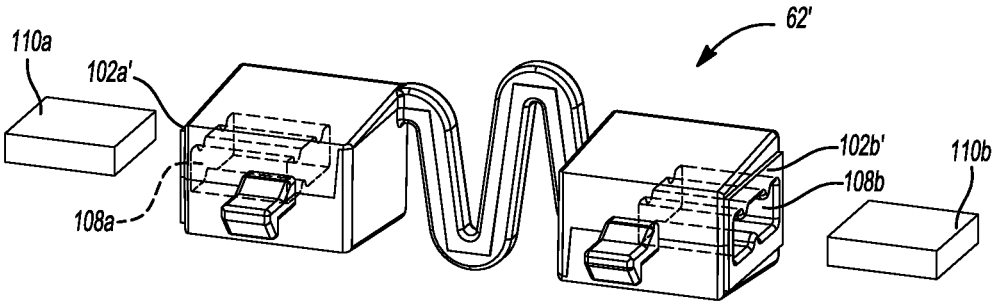
Figure 8:
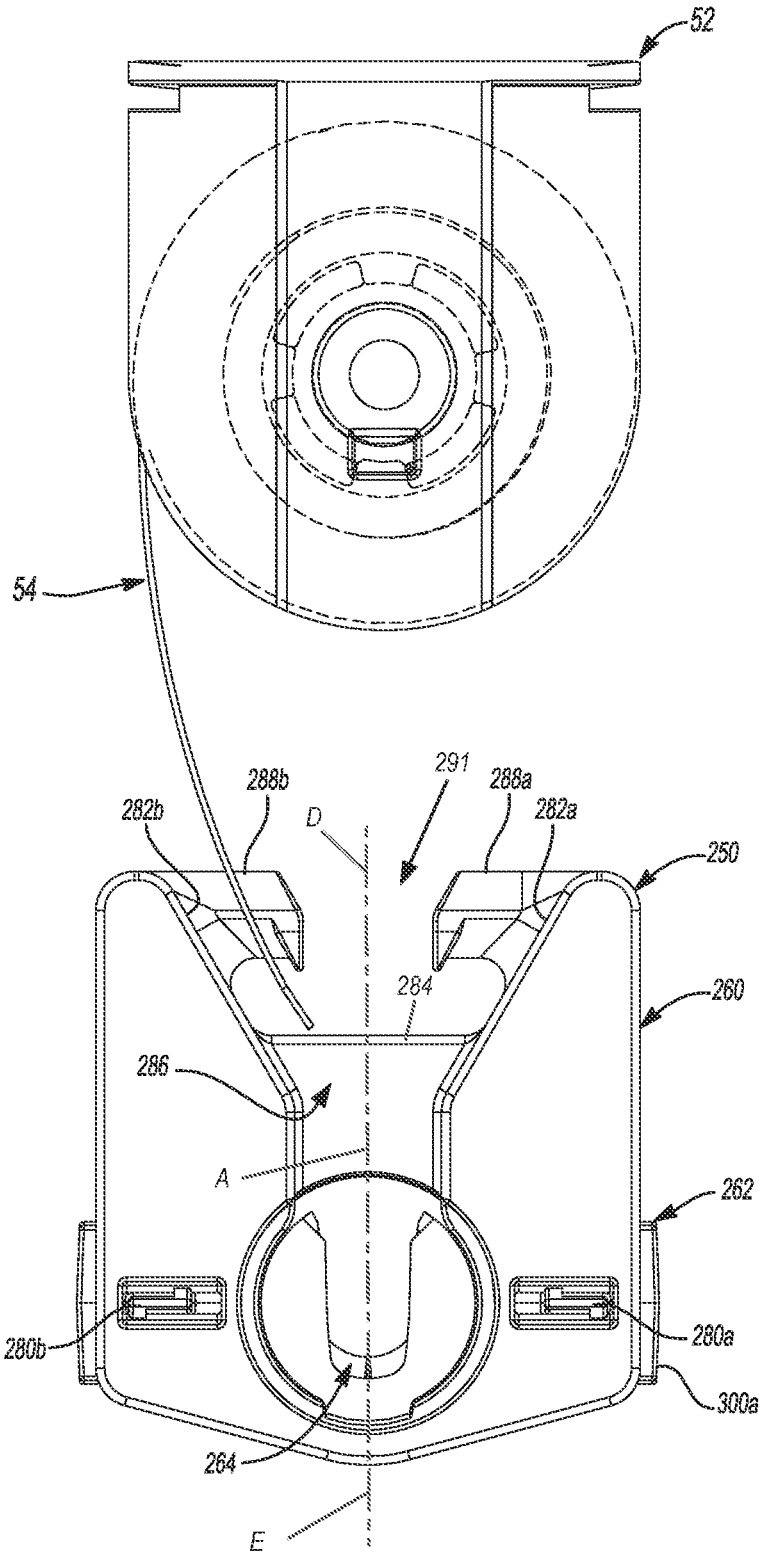
Figure 9:
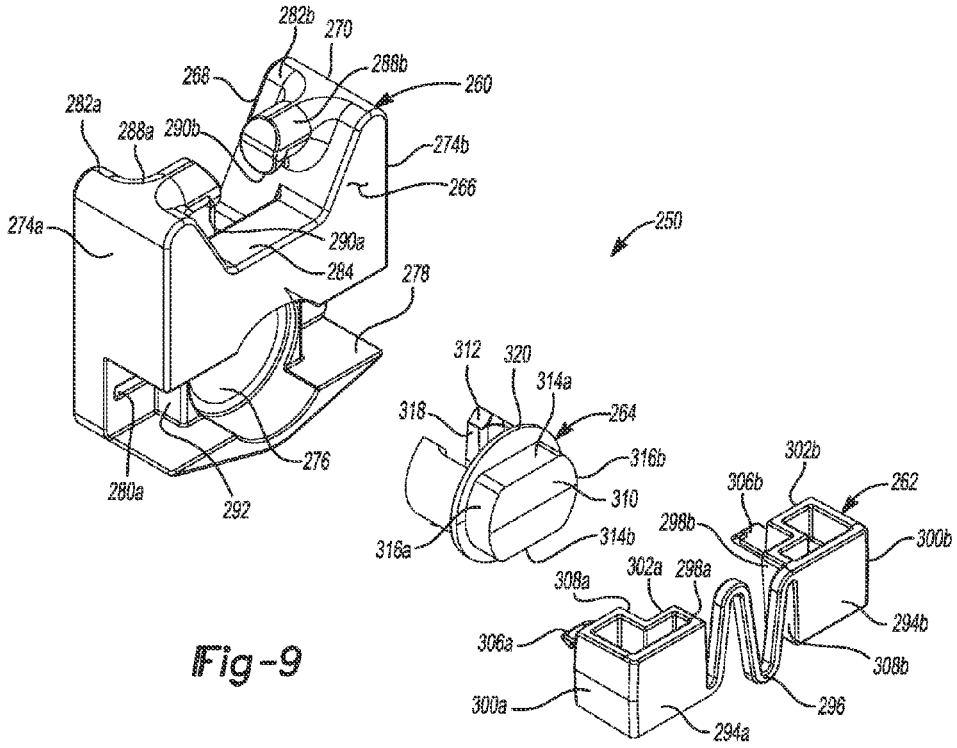
Figure 10:
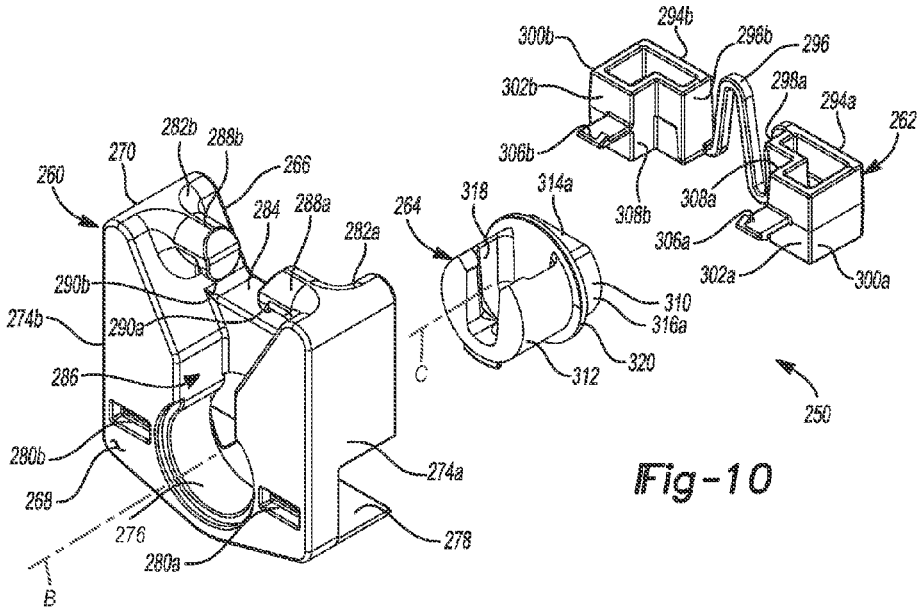
Figure 11:
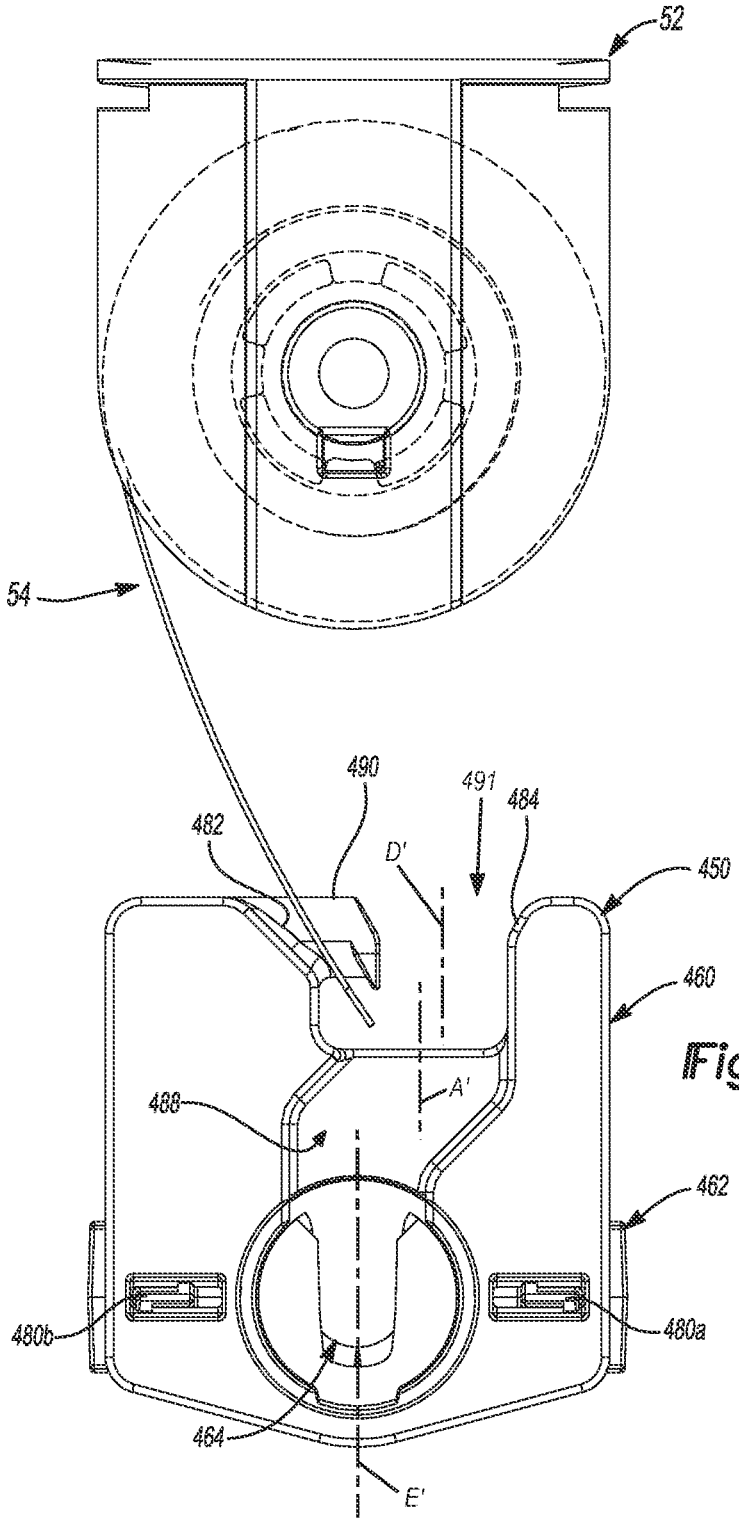
Figure 12:
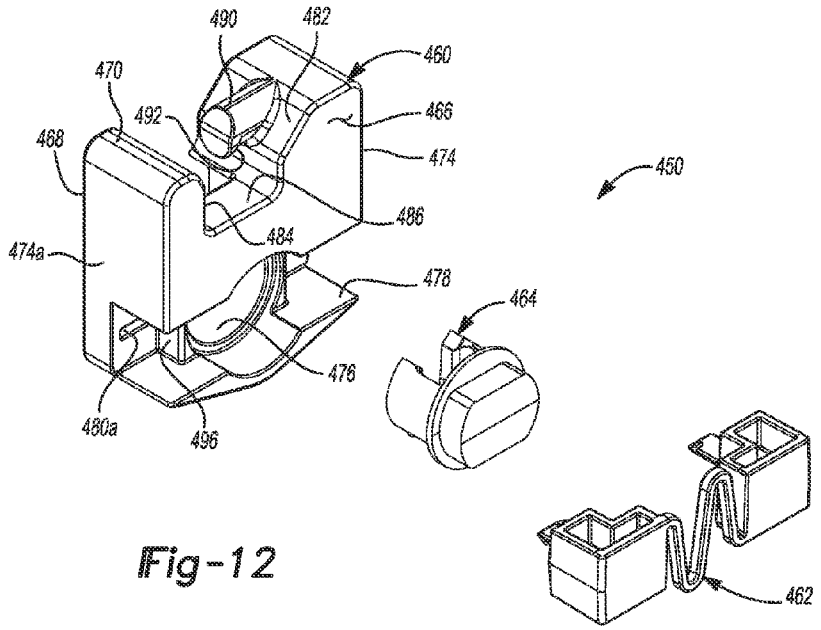
Figure 13:
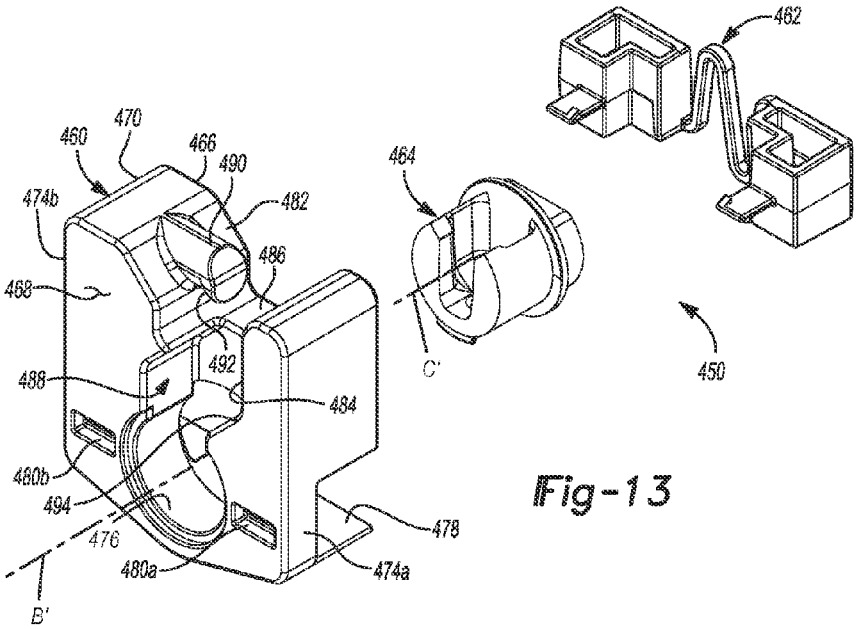
Figure 14:
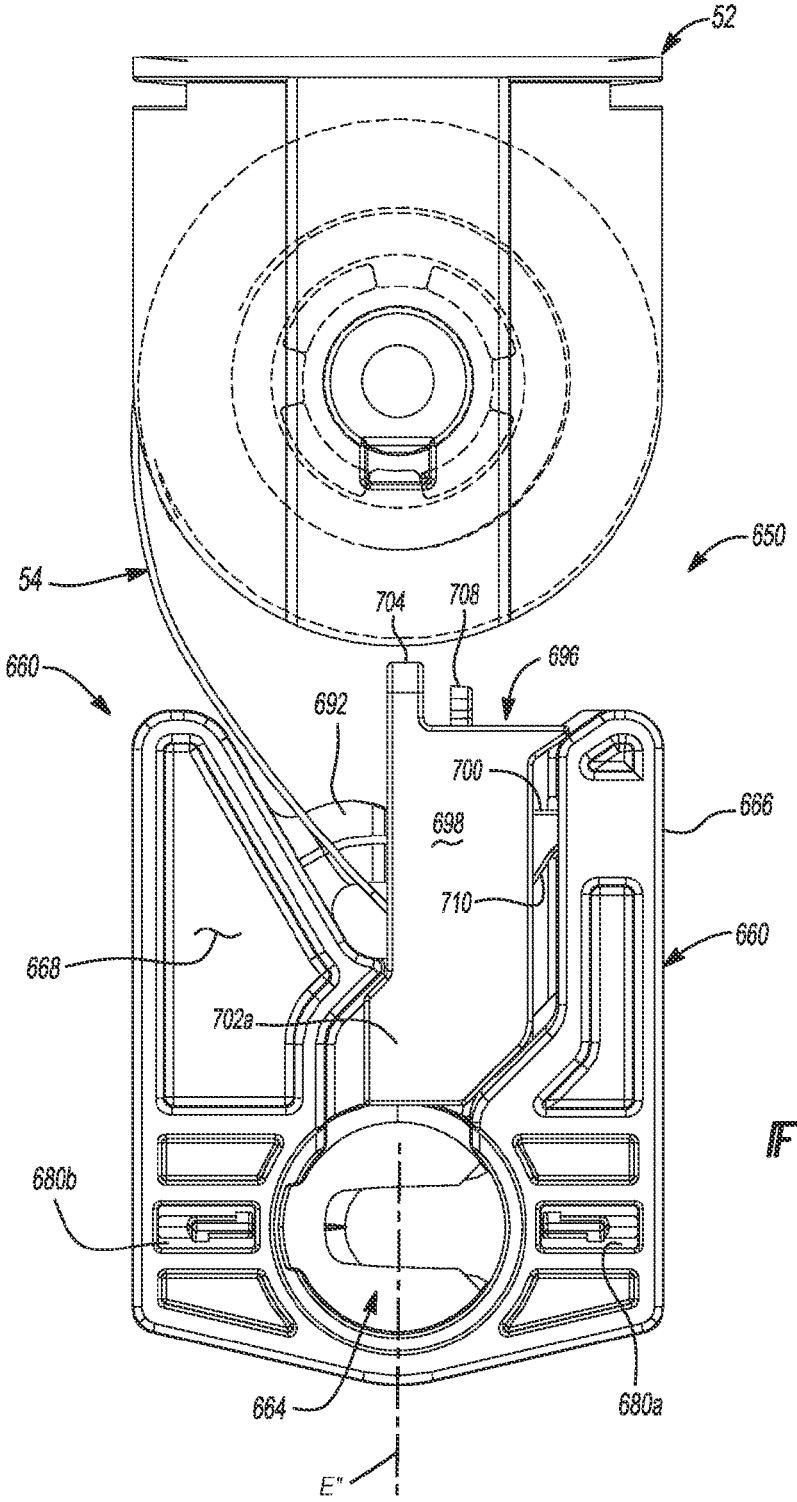
Figure 15:
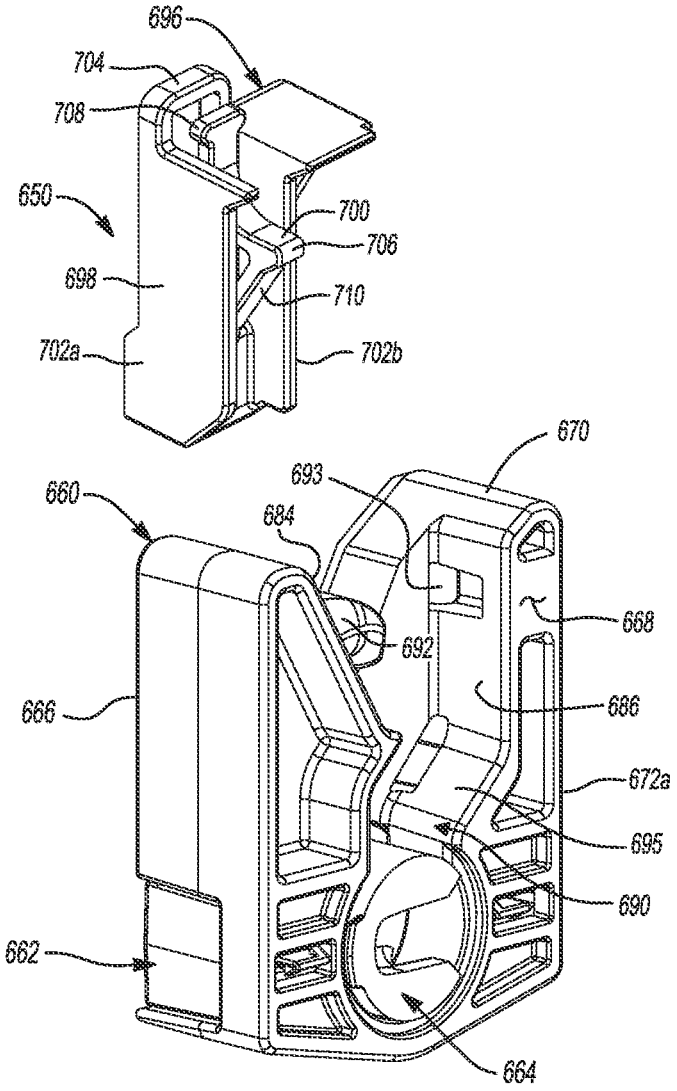
Figure 16:
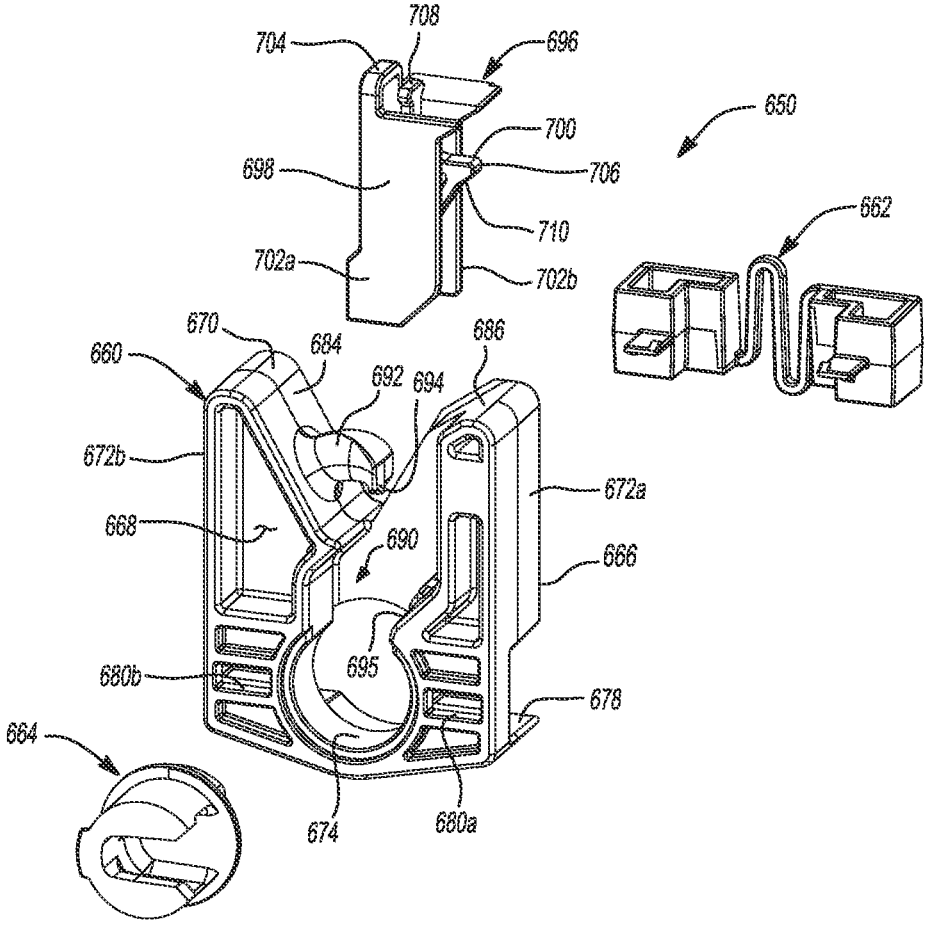

FIG. 5. is a partially cut-away perspective view of the window balance assembly of FIG. 2 installed in a window jamb according to the principles of the present disclosure;

FIG. 6. is a perspective view of an embodiment of a lock for use with the window balance assembly of FIG. 2 according to the principles of the present disclosure;

FIG. 7. is an exploded perspective view of the lock of FIG. 6;

FIG. 8 is a front view of an embodiment of a carrier assembly according to the principles of the present disclosure;

FIG. 9 is an exploded perspective view of the carrier assembly of FIG. 8;

FIG. 10 is another exploded perspective view of the carrier assembly of FIG. 8;

FIG. 11 is a front view of another embodiment of a carrier assembly according to the principles of the present disclosure;

FIG. 12 is an exploded perspective view of the carrier assembly of FIG. 11;

FIG. 13 is another exploded perspective view of the carrier assembly of FIG. 11;

FIG. 14 is a front view of another embodiment of a carrier assembly according to the principles of the present disclosure;

FIG. 15 is a partially exploded perspective view of the carrier assembly of FIG. 14; and FIG. 16 is an exploded perspective view of the carrier assembly of FIG. 14.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
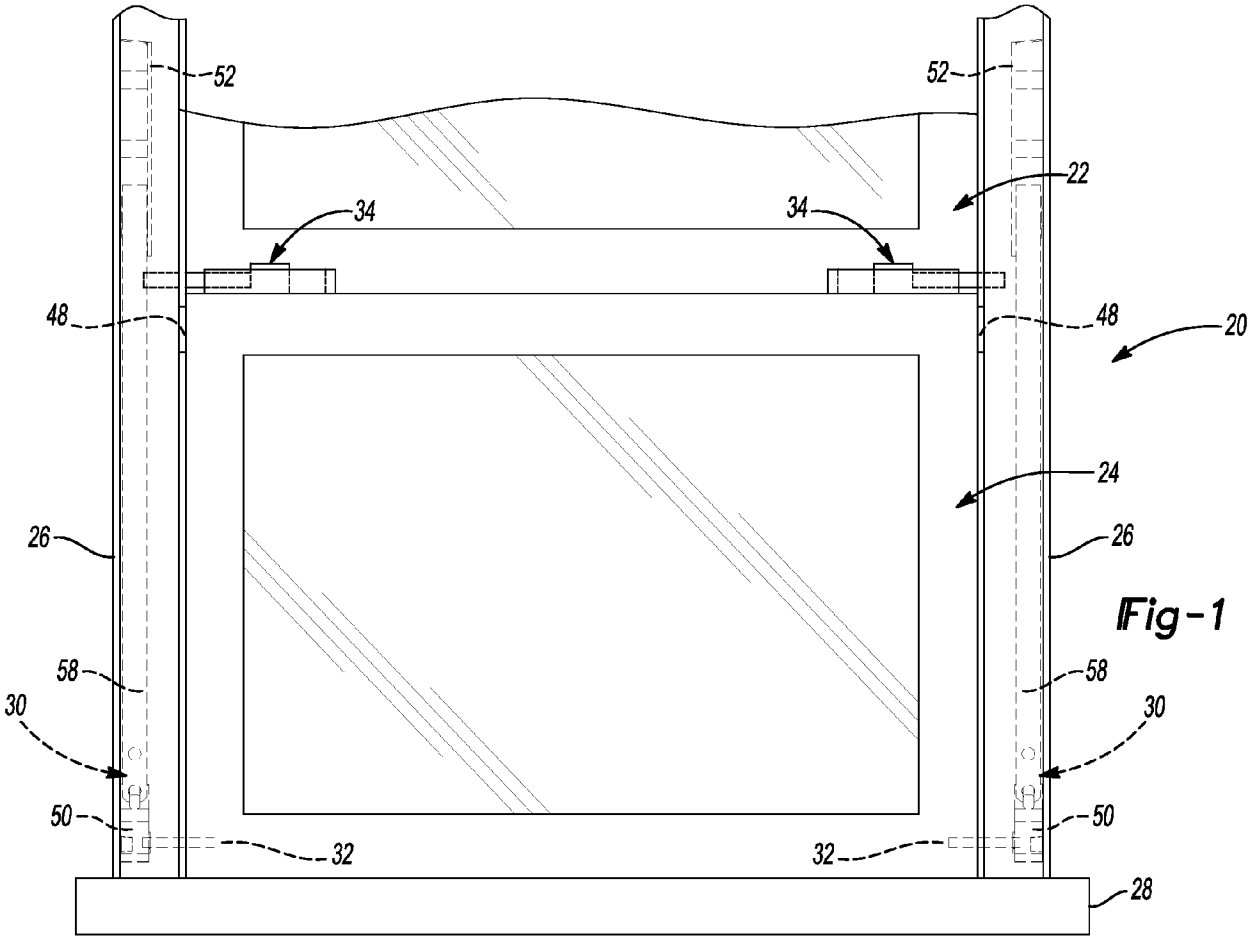
FIG. 1 is a partial front view of a window assembly including window balance assemblies according to the principles of the present disclosure.

With reference to FIG. 1, a window assembly 20 is provided that may include an upper sash 22, a lower sash 24, a pair of window jambs 26, a window sill 28, a header (not shown) and two or more window balance assemblies 30. In the particular embodiment illustrated in FIG. 1, the upper sash 22 is fixed relative to the window sill 28 and header (i.e., a single hung window assembly); however, in some embodiments, the upper sash 22 may be movable relative to the window sill 28 and header between a raised or closed position and a lowered or open position (i.e., a double hung window assembly). The lower sash 24 is connected to the window balance assemblies 30 to assist a user in raising and lowering the lower sash 24 between an open and closed position, respectively and to maintain the lower sash 24 at a desired vertical position relative to the window sill 28, for example.

As shown in FIG. 5, each window jamb 26 may include a jamb channel 36 defined by a first wall 38, a second wall 40 disposed opposite the first wall 38, and third and fourth walls 42, 44 disposed perpendicular to the first and second walls 38, 40. The first wall 38 may include a slot 46 extending vertically adjacent the lower sash 24. As shown, and as will be subsequently described, the window balance assembly 30 may be installed in the jamb channel 36.

With reference to FIGS. 1 and 5, the lower sash 24 may include a pair of pivot bars 32 and a pair of tilt latch mechanisms 34. Each pivot bar 32 may extend horizontally outward in an opposing direction from a lower portion of the lower sash 24 and through the slot 46 to selectively engage a corresponding window balance assembly 30 installed in a corresponding window jamb 26. Each tilt latch mechanism 34 may extend horizontally outward in an opposing direction from an upper portion of the lower sash 24 and through the slot 46 to selectively engage a corresponding window jamb 26. The tilt latch mechanisms 34 may be selectively actuated (i.e., retracted from the window jambs 26) to allow the lower sash 24 to pivot about the pivot bars 32 relative to the window jambs 26 to facilitate cleaning of an exterior side of the window assembly 20 and to allow separation of the lower sash 24 from the window assembly 20, for example.

It will be appreciated that in a double hung window assembly, the upper sash 22 may also be connected to two or more window balance assemblies to assist the user in opening the upper sash 22 and to maintain the upper sash 22 at a desired vertical position relative to the window sill 28. In such a window assembly, the upper sash 22 may also include tilt latch mechanisms and pivot bars to allow the upper sash 22 to function in the manner described above.

Figure 3:
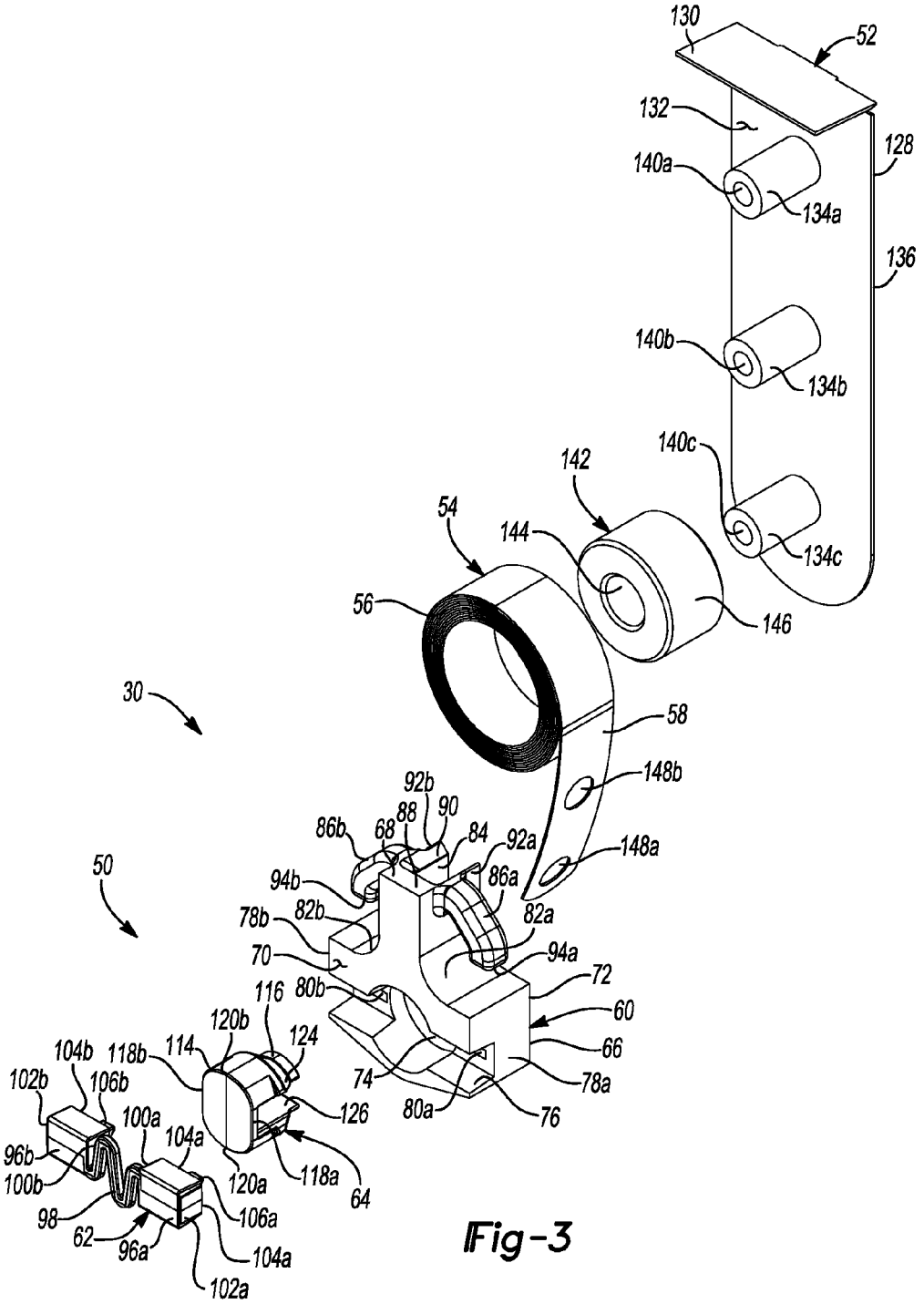
FIG. 3 is an exploded perspective view of the window balance assembly of FIG. 2.
Figure 4:
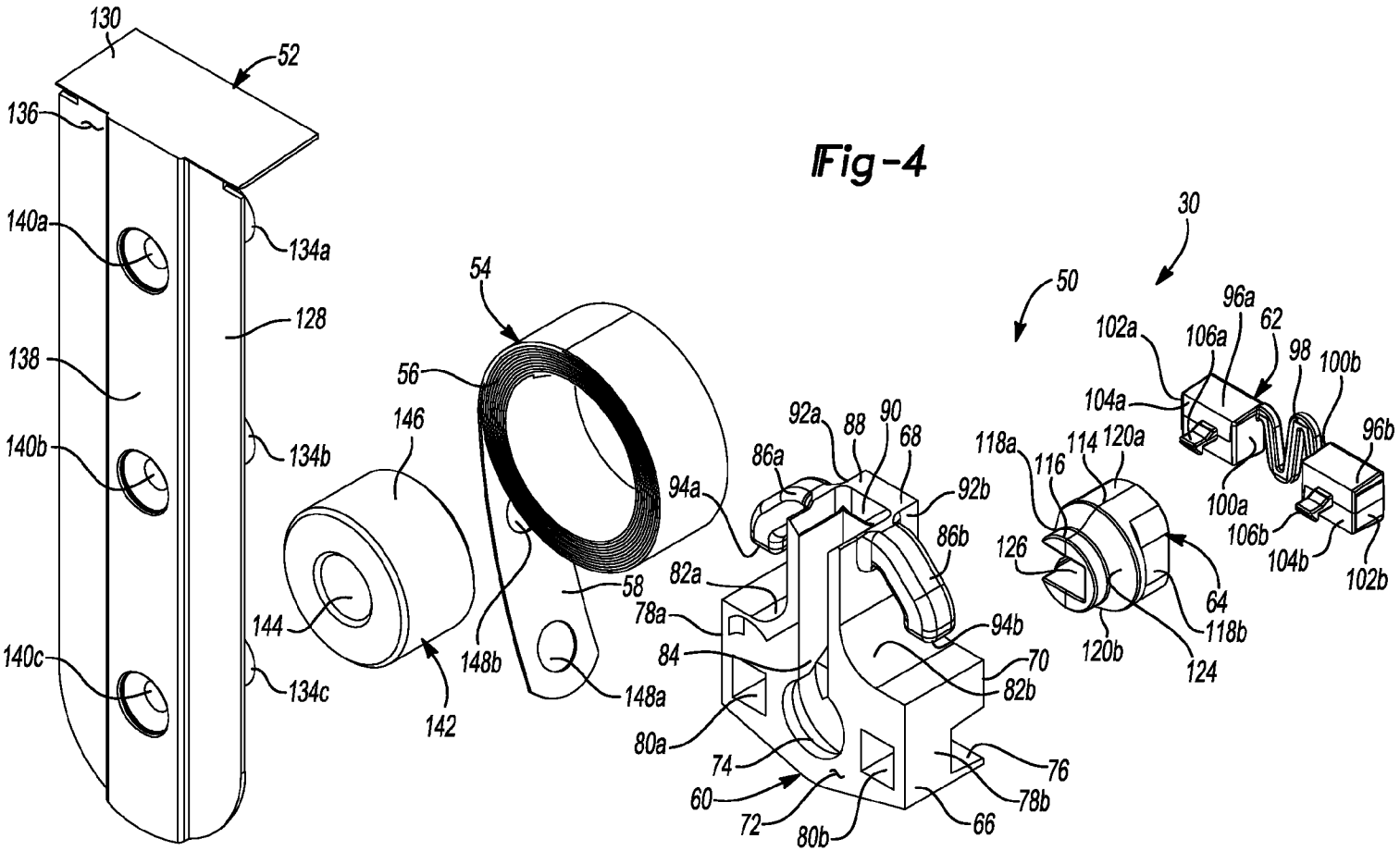
FIG. 4 is another exploded perspective view of the window balance assembly of FIG. 2.

Referring now to FIGS. 2-4, each window balance assembly 30 may include a carrier assembly 50 (also referred to as a shoe), a bracket 52 (also referred to as a cover) and a coil spring 54. It will be appreciated that the window balance assembly 30 may be modular, meaning one or more of the carrier assembly 50, bracket 52 and coil spring 54 can be replaced with a different carrier assembly, coil spring and/or bracket to suit a given application or set of specifications. It will also be appreciated that one or more of the carrier assembly 50, bracket 52 and coil spring 54 may be incorporated into other configurations or types of window balance assemblies (e.g., moving-coil, fixed-coil, constant-force, non-constant-force, etc.). It will further be appreciated that the carrier assembly 50, bracket 52 and coil spring 54 may be reversible so that the carrier assembly 50, bracket 52 and/or coil spring 54 may be installed in either of the window jambs 26 without requiring dedicated right-hand or left-hand parts.

The window balance assembly 30 shown in the figures is a fixed-coil window balance assembly, meaning, when the window balance assembly 30 is fully installed in the window jamb 26, the bracket 52 and the coil spring 54 are fixed relative to the window jamb 26, while the carrier assembly 50 is vertically movable with the lower sash 24 relative to the window jamb 26. A curled portion 56 of the coil spring 54 may be coupled to the bracket 52, while an uncurled end 58 of the coil spring 54 may be coupled to the carrier assembly 50, which also removably engages the pivot bar 32 of the lower sash 24. By virtue of its spring tension, the coil spring 54 may supply an upward counterbalance force on the carrier assembly 50 to biasing the lower sash 24 upward toward the open position to assist a user in raising and lowering the lower sash 24 and to maintain the lower sash 24 at a desired vertical position relative to the window sill 28, for example. Although the figures illustrate a window balance assembly 30 having a single coil spring 54, in some embodiments two or more coil springs 54 may be incorporated into a single window balance assembly 30 to increase the spring capacity of the window balance assembly 30 to assist a user in raising and lowering a heavier and/or larger lower sash between open and closed positions, and to maintain the heavier and/or larger lower sash at a desired vertical position relative to the window sill 28, for example.

The carrier assembly 50 may include a body 60, a lock 62 and a cam 64. The body 60 may be molded and/or machined from a polymeric or metallic material, for example, and may include a horizontal portion 66 and a vertical portion 68, each of which may share a front surface 70 and an opposing back surface 72. The horizontal portion 66 of the body 60 may include an aperture 74 and a first slot 76. The aperture 74 may extend through the front and back surfaces 70, 72 and may rotatably engage the cam 64 therein. The first slot 76 may extend through opposing sides 78*a*, 78*b* of the horizontal portion 66 along the front surface 70 and may be in communication with the aperture 74. A pair of openings 80*a*, 80*b* may extend from the first slot 76 through the back surface 72. Contoured or rounded surfaces 82*a*, 82*b* may extend between the horizontal portion 66 and the vertical portion 68.

The vertical portion 68 of the body 60 may include a generally vertically extending second slot 84 and a pair of projections 86*a*, 86*b*. The second slot 84 may extend downwardly along the back surface 72 from a top end 88 of the vertical portion 68 to the aperture 74. A vertical center line of the second slot 84 may be vertically aligned with and in communication with a center of the aperture 74 and a center rotational axis of cam 64 rotatably engaged in the aperture 74. At the top end 88, the second slot 84 may include rounded or chamfered edges 90. The projections 86*a*, 86*b* may extend outwardly from opposing sides 92*a*, 92*b* of the vertical portion 68, respectively, and may curve downwardly towards the horizontal portion 66. A distal end of each projection 86*a*, 86*b* may include a lip 94*a*, 94*b*, respectively. The uncurled end 58 of the coil spring 54 may be configured to engage either of the projections 86*a*, 86*b*. If the window balance assembly 30 includes multiple coil springs 54, the uncurled end 58 of each coil spring 54 may engage the same or different projections 86*a*, 86*b*. Accordingly, the coil spring 54 engages the carrier assembly 50 at a location that is vertically aligned with, or nearly vertically aligned with the rotational axis of the cam 64. In this regard, when the window balance assembly 30 is fully installed in the window jamb 26 and the pivot bar 32 is received in the cam 64, a moment is not generated (or may be reduced) by the upwardly counterbalance force applied by the coil spring 54 on the carrier assembly 50. Accordingly, the carrier assembly 50 does not rotate or cock in the jam channel 36 (or cocking or rotating of the carrier assembly 50 is reduced), but may instead move substantially vertically in the jamb channel 36. By reducing or eliminating cocking or rotating of the carrier assembly 50 in the jamb channel 36, a 30-40% reduction in operating forces (e.g., forces required to overcome static friction between the lower sash 24 and the jamb channel 36 and raise the lower sash 24 to an open position or lower the lower sash 24 to a closed position) may be realized when compared to other known window counterbalance assemblies. Additionally, reducing or eliminating cocking or rotating of the carrier assembly 50 in the jamb channel 36, damage or wear to the window balance assembly 30 and/or to the jamb channel 36 may be reduced or prevented.

The lock 62 may be molded and/or machined from a polymeric or metallic material, for example, and may include a pair of rectangular members 96*a*, 96*b* interconnected by a center member 98. Each rectangular member 96*a*, 96*b* may have an inner connecting surface 100*a*, 100*b*, an inner engaging surface 104*a*, 104*b*, and an outer locking surface 102*a*, 102*b*. The rectangular members 96*a*, 96*b* may be joined by the center member 98 at the inner connecting surfaces 100*a*, 100*b*. Barbed protuberances 106*a*, 106*b* may extend from the inner engaging surfaces 104*a*, 104*b*, respectively, and may engage a corresponding one of the openings 80*a*, 80*b* disposed in the body 60 to attach the lock 62 to the body 60. The barbed protuberances 106*a*, 106*b* may be movable within the openings 80*a*, 80*b* to allow the rectangular members 96*a*, 96*b* to move relative to each other and the body 60 without disengaging from the body 60.

The center member 98 of the lock 62 may be a resiliently expandable member having a sinusoidal shape, for example.

The center member 98 may be configured to expand and contract in response to the rotation of the cam 64 between a locked position (corresponding to a titled position of the lower sash 24) and an unlocked position (shown in FIG. 5; corresponding to a vertically upright position of the lower sash 24) as will be subsequently described. When the cam 64 is rotated to the locked position, the center member 98 may expand into an expanded state and the outer locking surfaces 102*a*, 102*b* of the rectangular members 96*a*, 96*b* may move away from each other and extend beyond the sides 78*a*, 78*b* of the body 60 to frictionally engage the third and fourth walls 42, 44 of the jamb channel 36. When the cam 64 is rotated to the unlocked position, the center member 98 may resiliently contract into a relaxed state and the outer locking surfaces 102*a*, 102*b* to move toward each other and out of frictional engagement with the third and fourth walls 42, 44 of the jamb channel 36. In the relaxed state, the outer locking surfaces 102*a*, 102*b* may be positioned generally flush with, or may only slightly extend beyond, or may be slightly recessed within the sides 78*a*, 78*b* of the body 60.

In an embodiment shown in FIGS. 6 and 7, another lock 62' is shown that may be incorporated into the window balance assembly 30 in place of the lock 62. The lock 62' may include cavities 108*a*, 108*b* in the outer locking surfaces 102*a*', 102*b*', respectively. The cavities 108*a*, 108*b* may receive a friction insert 110*a*, 110*b*, respectively, therein. The friction inserts 110*a*, 110*b* may be "high-friction inserts" (i.e., having a higher coefficient of friction than the rest of the lock 62') that may be fabricated from a high-pressure epoxy and/or fiberglass laminate die-cut, for example. The friction inserts 110*a*, 110*b* may be configured to frictionally engage the third and fourth walls 42, 44 of the jamb channel 36 when the cam 64 is rotated to the locked position.

With continued reference to FIGS. 2-4, the cam 64 may be molded and/or machined from a polymeric or metallic material, for example, and may be generally defined as an elliptic member 114 coupled with a circular projection 116. The elliptic member 114 may include a pair of generally liner edges 118*a*, 118*b* and a pair of generally curved edges 120*a*, 120*b*. The circular projection 116 may extend outwardly from a back surface 124 of the elliptic member 114 and may rotatably engage the aperture 74 of the body 60. A third slot 126 may extend partially through the generally liner edge 118*a* and the circular projection 116.

As described above, the cam 64 may be rotatable within the aperture 74 of the body 60 between the locked positioned and the unlocked position. In the locked position (corresponding to a titled position of the lower sash 24), the curved edges 120*a*, 120*b* of the cam 64 may exert an outwardly force on the inner connecting surfaces 100*a*, 100*b* of the lock 62 and may provide for the rectangular members 96*a*, 96*b* to move away from each other. In this regard, the center member 98 may expand into the expanded state and the outer locking surfaces 102*a*, 102*b* may frictionally engage the third and fourth walls 42, 44 of the jamb channel 36. Frictionally engaging the outer locking surfaces 102*a*, 102*b* against the third and fourth walls 42, 44 of the jamb channel 36 may create or increase friction between the carrier assembly 50 and the jamb channel 36 sufficient to lock the carrier assembly 50 in place and restrict the carrier assembly 50 from moving upward and/or downward in the window jamb 26. If the outer locking surfaces 102*a*, 102*b* include the friction inserts 110*a*, 110*b* shown in FIGS. 6 and 7, the friction inserts 110*a*, 110*b* may engage the third and fourth walls 42, 44 of the jamb channel 36 with more friction, which may be useful in applications where the lower sash 24 is larger and/or heavier, for example. In the locked position, the third slot 126 of the cam 64 may be aligned with the second slot 84 of the body 60, which may allow for "drop-in" installation of the pivot bar 32 into the third slot 126 of the cam 64. Further, in the locked position, the pivot bar 32 may be removed from the third slot 126 of the cam 64 and from the carrier assembly 50, which may allow for the lower sash 24 to be separated from the window assembly 20. The location of the projections 86*a*, 86*b* on the body 60 allows for the coil spring 54 to be attached to the carrier assembly 50 at a location that is nearly vertically aligned with the second slot 84 and the third slot 126 of the cam 64 (when the cam 64 is in the locked position) without impeding a vertical path for drop-in installation and removal of the pivot bar 32.

When the cam 64 is rotated into the unlocked position (shown in FIG. 5; corresponding to a vertically upright position of the lower sash 24), the curved edges 120*a*, 120*b* of the cam 64 may not exert an outwardly force on the inner connecting surfaces 100*a*, 100*b* of the lock 62. Accordingly, the center member 98 may resiliently contract into the relaxed state and the outer locking surfaces 102*a*, 102*b* may move towards each other. In this regard, the outer locking surfaces 102*a*, 102*b* may only slightly extend beyond, or may be slightly recessed within, or may be flush with the sides 78*a*, 78*b* of the body 60, which may reduce or eliminate friction between the carrier assembly 50 and the jamb channel 36. In this regard, the carrier assembly 50 may be generally unrestricted from moving upward and/or downward in the window jamb 26 as the lower sash 24 is moved between the open and closed positions.

The bracket 52 may be formed from a polymeric material and/or a metallic material, for example, and may include a base 128 and a top 130. The base 128 may include a front surface 132 having a plurality of outwardly extending cylindrical projections 134*a*, 134*b*, 134*c* and an opposing back surface 136 having an elongated raised portion 138. An aperture 140*a*, 140*b*, 140*c* may extend through each of the cylindrical projections 134*a*, 134*b*, 134*c* and through the front and back surfaces 132, 136. As shown in FIG. 5, fasteners 141*a*, 141*b*, 141*c* may be received in the apertures 140*a*, 140*b*, 140*c*, respectively, to fixedly mount the bracket 52 to the second wall 40 of the window jam 26.

The top 130 of the bracket 52 may extend generally perpendicular to the base 128 and may be sized and shaped to fit in the jamb channel 36 to restrict or prevent airflow from passing through the jamb channel 36 and/or debris from falling into the jamb channel 36, for example. A spool 142 fabricated from nylon or an acetyl material for example may have a center aperture 144 rotatably engaging one of the cylindrical projections 134*a*, 134*b*, 134*c* of the bracket 52. The spool 142 may also include an outer surface 146 upon which the curled portion 56 of the coil spring 54 is received via a press-fit, for example. The coil spring 54 may be a coiled ribbon spring that supplies a constant retraction force when unwound. The uncurled end 58 of the coil spring 54 may include at least one aperture 148*a*, 148*b* engaging one of the attachment projections 86*a*, 86*b* of the body 60.

With reference to FIGS. 1-5, a method of installing the window balance assembly 30 in the window assembly 20 will be described. Installation of the window balance assembly 30 may begin by inserting the window balance assembly 30 into the jamb channel 36 of the window jamb 26. This may be accomplished by inserting the window balance assembly 30 through an open end of the jamb channel 36 before the window jamb 26 is fastened to the window sill 28 and/or header of the window assembly 20, for example. Alternatively, the window balance assembly 30 may be inserted into the jamb channel 36 through a cutout 48 in the jamb channel 36 disposed between the upper and lower ends of the window jamb 26, as shown in FIG. 1. The window balance assembly 30 may be easily inserted into and removed from the jamb channel 36 through the cutout 48 even after the window jamb 26 is installed in the window frame (i.e., after the window jamb 26 is fixed to the window frame header and sill) without disassembling or removing the window jamb 26 from the window assembly 20. After the window balance assembly 30 is received into the jamb channel 36, the bracket 52 may be secured to the jamb channel 36 by driving the fasteners 141*a*, 141*b*, 141*c* into the apertures 140*a*, 140*b*, 140*c*, respectively, and into the second wall 40 of the jamb channel 36.

With reference to FIGS. 8-10, another carrier assembly 250 is provided that could be incorporated into the window balance assembly 30 described above in place of the carrier assembly 50. The carrier assembly 250 may include a body 260, a lock 262, and a cam 264.

The body 260 may be molded and/or machined from a polymeric or metallic material, for example, and may include a front surface 266 and an opposing back surface 268, a top edge 270, and opposing sides 274*a*, 274*b*. The body 260 may include an aperture 276 extending through the front and back surfaces 266, 268 and may rotatably engage the cam 264 therein. The aperture 276 may be in communication with a horizontal first slot 278 extending along the front surface 266 and through the sides 274*a*, 274*b*. A frame 292 may surround a portion of the aperture 276 in the first slot 278 and a pair of openings 280*a*, 280*b* may extend from the first slot 278 through the back surface 268. Along the front surface 266, a pair of opposing walls 282*a*, 282*b*may slope downwardly from the top edge 270 to a horizontally extending ledge 284. Along the back surface 268, the walls 282*a*, 282*b* may slope downwardly from the top edge 270 to a generally vertically extending second slot 286. As shown in FIG. 8, a center line A of the second slot 286 may be vertically aligned with a center axis B of the aperture 276 and a center axis C of the cam 264 rotatably engaged therein, and a vertical center line E of the aperture 276. Inwardly facing projections 288*a*, 288*b* may extend from the walls 282*a*, 282*b*, respectively. The projections 288*a*, 288*b* may be centered between the front and back surfaces 266, 268. A distal end of each projection 288*a*, 288*b* may include a lip 290*a*, 290*b*. A gap 291 having a center axis D may extend between the lips 290*a*, 290*b* of the projections 288*a*, 288*b*, which may be vertically aligned with the center line E of the aperture 276 and the center axis C of the cam 264 rotatably engaged therein. The uncurled end 58 of the coil spring 54 may be configured to engage either of the projections 288*a*, 288*b*. If the window balance assembly 30 includes multiple coil springs 54, the uncurled end 58 of each coil spring 54 may engage the same or different projections 288*a*, 288*b*. Accordingly, the coil spring 54 engages the carrier assembly 250 at a location that is vertically aligned with, or nearly vertically aligned with, the center line E of the aperture 276. In this regard, when the window balance assembly 30 is fully installed in the window jamb 26 and the pivot bar 32 is received in the cam 264, a moment is not generated (or may be reduced) by the upwardly counterbalance force of the coil spring 54 acting on the carrier assembly 250. Accordingly, the carrier assembly 250 does not rotate or cock in the jamb channel 36 (or cocking or rotating of the carrier assembly 250 is reduced), but may instead move vertically in the jamb channel 36. By reducing or eliminating cocking or rotating of the carrier assembly 250 in the jamb channel 36, a 30-40% reduction in operating forces (e.g., forces required to overcome static friction between the lower sash 24 and the jamb channel 36 and raise the lower sash 24 to an open position or lower the lower sash 24 to a closed position) may be realized when compared to other known window counterbalance assemblies. Additionally, reducing or eliminating cocking or rotating of the carrier assembly 250 in the jamb channel 36, damage or wear to the window balance assembly 30 and/or to the jamb channel 36 may be reduced or prevented.

The lock 262 may be molded and/or machined from a polymeric or metallic material, for example, and may include a pair of rectangular members 294*a*, 294*b* interconnected by a center member 296. Each rectangular member 294*a*, 294*b* may have an inner connecting surface 298*a*, 298*b* where the rectangular members 294*a*, 294*b* are joined by the center member 296 and an outer locking surface 300*a*, 300*b* selectively engaging the third and fourth walls 42, 44 of the jamb channel 36. A barbed protuberance 306*a*, 306*b* may extend from the inner engaging surface 302*a*, 302*b* of the rectangular members 294*a*, 294*b*, respectively, and may engage a corresponding one of the openings 280*a*, 280*b* of the body 260 to attach the lock 262 to the body 260. The barbed protuberances 306*a*, 306*b* may be moveable within the openings 280*a*, 280*b* to allow the rectangular members 294*a*, 294*b* to move relative to each other and the body 260 without disengaging from the body 260. Each rectangular member 294*a*, 294*b* may also include a notch 308*a*, 308*b* that may engage the frame 292 of the first slot 278.

The center member 296 of the lock 262 may be a resiliently expandable member having a sinusoidal shape, for example. Similar to the center member 98 of the lock 62 described above, the center member 296 may be configured to expand and contract in response to rotation of the cam 264 between a locked position (corresponding to a titled position of the lower sash 24) and an unlocked position (corresponding to a vertically upright position of the lower sash 24), respectively. When the cam 264 is rotated to the locked position, the center member 296 may expand and the outer locking surfaces 300*a*, 300*b* may frictionally engage the third and fourth walls 42, 44 of the jamb channel 36. When the cam 264 is rotated to the unlocked position, the center member 296 may resiliently contract and the outer locking surfaces 300*a*, 300*b* to move toward each other and out of frictional engagement with the third and fourth walls 42, 44 of the jamb channel 36.

The cam 264 may be molded and/or machined from a polymeric or metallic material, for example, and may be generally defined as an elliptic member 310 coupled to a cylindrical member 312. The cylindrical member 312 may rotatably engage the aperture 276 of the body 260. The elliptic member 310 may include a pair of generally liner edges 314*a*, 314*b* and a pair of generally curved edges 316*a*, 316*b*. A third slot 318 may extend partially through the cylindrical member 312. A flange 320 may extend between the elliptic member 310 and the cylindrical member 312 and may prevent the cam 264 from passing through the aperture 276 of the body 260, for example.

As described above, the cam 264 may be rotatable within the aperture 276 of the body 260 between the locked position and the unlocked position. Similar to the cam 64 described above, in the locked position (corresponding to a tilted position of the lower sash 24), the curved edges 316*a*, 316*b* may be configured to exert an outwardly force on the inner connecting surfaces 298*a*, 298*b* of the lock 262. Accordingly, the outer locking surfaces 300*a*, 300*b* may frictionally engage the third and fourth walls 42, 44 of the jamb channel 36 which may create or increase friction between the carrier assembly 250 and the jamb channel 36 sufficient to lock the carrier assembly 250 in place and restrict the carrier assembly 250 from moving upward and/or downward in the window jamb 26. In the locked position, the third slot 318 of the cam 264 may be vertically aligned with the second slot 286 of the body 260, which may allow for "drop-in" installation of the pivot bar 32 into the cam 264 and also allow for removal of the pivot bar 32 from the cam 264. As shown, the gap 291 between the projections 288*a*, 288*b* may provide clearance for the pivot bar 32 to vertically drop into and lift out of the cam 264 when the cam 264 is in the locked position.

When the cam 264 is rotated into the unlocked position (corresponding to a vertical, upright and non-tilted position of the lower sash 24), the curved edges 316*a*, 316*b* of the cam 264 may not exert an outwardly force on the inner connecting surface 298*a*, 298*b* of the lock 262. Accordingly, the outer locking surfaces 300*a*, 300*b* may frictionally disengage from the third and fourth walls 42, 44 of the jamb channel 36, allowing the carrier assembly 250 to move generally unrestricted upward and/or downward in the window jamb 26 as the lower sash 24 is moved between the open and closed positions.

With reference to FIGS. 11-13, another carrier assembly 450 is provided that could be incorporated into the window balance assembly 30 described above in place of carrier assembly 50 or carrier assembly 250. The carrier assembly 450 may include a body 460, a lock 462, and a cam 464.

The body 460 may be molded and/or machined from a polymeric or metallic material, for example, and may include a front surface 466 and an opposing back surface 468, a top edge 470, and opposing sides 474*a*, 474*b*. The body 460 may include an aperture 476 extending through the front and back surfaces 466, 468 and may rotatably engage the cam 464 therein. The aperture 476 may be generally centered between the sides 474*a*, 474*b* of the body 460 and may be in communication with a horizontally extending first slot 478. The first slot 478 may extend through the sides 474*a*, 474*b* of the body 460 along the front surface 466. A pair of openings 480*a*, 480*b* may extend from the first slot 478 through the back surface 468. A frame 496 may surround a portion of the aperture 476 in the first slot 478. Along the front surface 466, a pair of opposing walls 482, 484 may slope downwardly from the top edge 470 to a horizontally extending ledge 486. Along the back surface 468, the walls 482, 484 may slope downwardly from the top edge 470 to an laterally offset second slot 488 having a bend 494 and a vertical axis A'. An inwardly facing projection 490 having a lip 492 at a distal end thereof may extend from the wall 482. The projection 490 may be centered between the front and back surfaces 466, 468. As shown in FIG. 11, the projection 490 may be vertically aligned with the center axis B' of the aperture 476 and the rotational axis C' of the cam 464 rotatably engaged therein, and may be aligned with or intersect a vertical center line E' of the aperture 476. A gap 491, having a center axis D', may extend between the lip 492 of the projection 490 and the wall 484. The center axis D' may be laterally offset from the vertical center line E' of the aperture 476 and the vertical axis A' of the second slot 488.

The uncurled end 58 of the coil spring 54 may be configured to engage the projection 490. If the window balance assembly 30 includes multiple coil springs 54, the uncurled end 58 of each coil spring 54 may also engage the projection 490. Accordingly, the coil spring 54 engages the carrier assembly 450 at a location that is vertically aligned with or nearly vertically aligned with the center line E'of the aperture 476. In this regard, when the window balance assembly 30 is fully installed in the window jamb 26 and the pivot bar 32 is received in the cam 464, a moment is not generated (or may be reduced) by the upwardly counterbalance force of the coil spring 54 acting on the carrier assembly 450. Accordingly, the carrier assembly 450 does not rotate or cock in the jamb channel 36 (or cocking or rotating of the carrier assembly 50 is reduced), but may instead move substantially vertically in the jamb channel 36. By reducing or eliminating cocking or rotating of the carrier assembly 450 in the jamb channel 36, a 30-40% reduction in operating forces (e.g., forces required to overcome static friction between the lower sash 24 and the jamb channel 36 and raise the lower sash 24 to an open position or lower the lower sash 24 to a closed position) may be realized when compared to other known window counterbalance assemblies. Additionally, reducing or eliminating cocking or rotating of the carrier assembly 450 in the jamb channel 36, damage or wear to the window balance assembly 30 and/or to the jamb channel 36 may be reduced or prevented.

The lock 462 may be substantially similar to the lock 262 described above, and the cam 464 may be substantially similar to the cam 264 described above. That is, the cam 464 may rotate in the aperture 476 of the body 460 between a locked positioned and an unlocked position. In the locked position (corresponding to a tilted position of the lower sash 24), the cam 464 may engage the lock 462 and provide for the lock 462 to frictionally engage the third and fourth walls 42, 44 of the jamb channel 36 to create or increase friction between the carrier assembly 450 and the jamb channel 36 sufficient to lock the carrier assembly 450 in place and restrict the carrier assembly 450 from moving upward and/or downward in the window jamb 26. In the locked position, the pivot bar 32 may be vertically "dropped into" the cam 464 and also vertically removed from the cam 464. As shown in FIG. 11, the gap 491 and the positioning of the projection 490 relative to the second slot 488 at the top edge 470 may provide clearance for the pivot bar 32 to be vertically dropped into and vertically lifted out of the cam 464 when the cam 464 is rotated to the locked position.

When the cam 464 is rotated to the unlocked position (corresponding to a vertical, upright and non-tilted position of the lower sash 24), the cam 464 may provide for the lock 462 to frictionally disengage from the third and fourth walls 42, 44 of the jamb channel 36 and allow the carrier assembly 450 to move generally unrestricted upward and/or downward in the window jamb 26 as the lower sash 24 is moved between the open and closed positions.

With reference to FIGS. 14-16, another carrier assembly 650 is provided that could be incorporated into the window balance assembly 30 described above in place of the carrier assembly 50, carrier assembly 250, or carrier assembly 450. The carrier assembly 650 may include a body 660, a lock 662, a cam 664, and an interlock insert 696.

The body 660 may be molded and/or machined from a polymeric or metallic material, for example, and may include a front surface 666 and an opposing back surface 668, a top edge 670, and opposing sides 672*a*, 672*b*. The body 660 may include an aperture 674 extending through the front and back surfaces 666, 668 and may rotatably engage the cam 664 therein. The aperture 674 may be generally centered between the sides 672*a*, 672*b* of the body 660 and may be in communication with a horizontally extending first slot 678. The first slot 678 may extend through the sides 672*a*, 672*b* along the front surface 666. A frame may surround a portion of the aperture 674 in the first slot 678. A pair of openings 680*a*, 680*b* may extend from the first slot 678 through the back surface 268. Along the back surface 668, a pair of walls 684, 686 may slope downwardly from the top edge 670 to an eccentric second slot 690 having a bend 695. The second slot 690 may be aligned with and in communication with the aperture 674 and the cam 664 rotatably engaged therein. An inwardly facing projection 692 having a lip 694 at a distal end thereof may extend from the wall 684. The projection 692 may be centered between the front and back surfaces 666, 668. The projection 692 may be vertically aligned with the aperture 674 and the cam 664 rotatably engaging the aperture 674 and may intersect a center line E" of the aperture 674.

The uncurled end 58 of the coil spring 54 may be configured to engage the projection 692. If the window balance assembly 30 includes multiple coil springs 54, the uncurled end 58 of each coil spring 54 may engage the projection 692. Accordingly, the coil spring 54 engages the carrier assembly 650 at a location that is vertically aligned with, or nearly vertically aligned with the center line E" of the aperture 674. In this regard, when the window balance assembly 30 is fully installed in the window jamb 26 and the pivot bar 32 is received in the cam 664, a moment is not generated (or may be reduced) by the upwardly counterbalance force of the coil spring 54 acting on the carrier assembly 650. Accordingly, the carrier assembly 650 does not rotate or cock in the jamb channel 36 (or cocking or rotating of the carrier assembly 50 is reduced), but may instead move substantially vertically in the jamb channel 36. By reducing or eliminating cocking or rotating of the carrier assembly 650 in the jamb channel 36, a 30-40% reduction in operating forces (e.g., forces required to overcome static friction between the lower sash 24 and the jamb channel 36 and raise the lower sash 24 to an open position or lower the lower sash 24 to a closed position) may be realized when compared to other known window counterbalance assemblies.

Additionally, reducing or eliminating cocking or rotating of the carrier assembly 650 in the jamb channel 36, damage or wear to the window balance assembly 30 and/or to the jamb channel 36 may be reduced or prevented.

The lock 662 may be substantially similar to the lock 262 described above and, the cam 664 may be substantially similar to the cam 264 described above. That is, the cam 664 may rotate in the aperture 674 of the body 660 between a locked positioned and an unlocked position. In the locked position (corresponding to a tilted position of the lower sash 24), the cam 664 may engage the lock 662 and provide for the lock 662 to frictionally engage the third and fourth walls 42, 44 of the jamb channel 36 to create or increase friction between the carrier assembly 650 and the jamb channel 36 sufficient to lock the carrier assembly 650 in place and restrict the carrier assembly 650 from moving upward and/or downward in the window jamb 26. In the locked position, the pivot bar 32 may be vertically "dropped into" the cam 664 and also vertically removed from the cam 664. As shown, the positioning of the projection 692 relative to the second slot 690 at the top edge 670 may provide clearance for the pivot bar 32 to vertically drop into and vertically lift out of the cam 664 when the cam 664 is in the locked position.

When the cam 664 is rotated to the unlocked position (corresponding to a vertical, upright and non-tilted position of the lower sash 24), the cam 664 may provide for the lock 662 to frictionally disengage from the third and fourth walls 42, 44 of the jamb channel 36 and allow the carrier assembly 650 to move generally unrestricted upward and/or downward in the window jamb 26 as the lower sash 24 is moved between the open and closed positions.

The interlock insert 696 may be designed to securely, but not permanently, engage the carrier assembly 650 when the window balance assembly 30 is fully installed in the window jamb 26. The interlock insert 696 may restrict unauthorized and/or unintentional removal of the lower sash 24 from the window assembly 20 by preventing the pivot bar 32 from being removed from the cam 664 when the cam 664 is in the locked position.

The interlock insert 696 may be molded and/or machined from a polymeric or metallic material, for example, and may be generally defined as an eccentric slotted rectangular member 698 including a locking mechanism 700. The rectangular member 698 may include a pair of opposing legs 702*a*, 702*b* joined by a rib 704. The legs 702*a*, 702*b* may be configured to conform to the geometry and contour of the second slot 690 and the second wall 686 of the body 660. In addition to joining the legs 702*a*, 702*b* the rib 704 may be configured to assist a user in unlocking the locking mechanism 700, as will be subsequently described.

The locking mechanism 700 may be integrally formed with rectangular member 698 or may be fixedly attached thereto. The locking mechanism 700 may include a latch 706 connected to a tab 708. The latch 706 may be configured to resiliently flex from a locked position to an unlocked position. That is, the latch 706 may be generally in the locked position but can be flexed into an unlocked position when a force is applied to a bottom edge 710 of the latch 706, such that the latch 706 moves generally angularly towards the rib 704. When the force is removed from the bottom edge 710, the latch 706 may resiliently move back into the locked position. Alternatively, a user may depress the tab 708 towards the rib 704 to move the latch 706 generally angularly towards the rib 704 and into the unlocked position. By releasing the tab 708, the latch 706 may resiliently move back into the locked position.

Once the window balance assembly 30 is fully installed in the jamb channel 36, and once the pivot bar 32 is received in the cam 664, the interlock insert 696 can be installed onto the body 660. As the interlock insert 696 is lowered down onto the body 660, the bottom edge 710 of the latch 706 may be configured to contact the second wall 686 at the top edge 670 to angularly flex the latch 706 into the unlocked position. Once the latch 706 aligns with an opening 693 in the second wall 686, the latch 706 may resiliently move back into the locked position and engage the opening 693. Accordingly, the pivot bar 32 may be restricted from being removed from the cam 664 when the cam 664 is in either the locked position or the unlocked position, and as such, the lower sash 24 may be restricted from the window assembly 20.

Removal of the interlock insert 696 may be accomplished by depressing the tab 708 in a direction towards the rib 704 such that the latch 706 angularly moves into the unlocked state. The interlock insert 696 may then be drawn upwards and separated from the body 660.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A counterbalance assembly for a tilt-in window having a pivot bar, the counter balance assembly and the tilt-in window installed in a window jamb having a jamb channel, the counter balance assembly comprising:

a bracket fixedly mounted to the jamb channel;

a first spring having a first portion and a second portion, the first portion of the first spring coupled to the bracket; and a carrier assembly having a vertically extending first slot, an aperture in communication with the vertically extending slot, a cam having a rotational axis and rotatably engaging the aperture, and a first projection, the vertically extending first slot configured to receive the pivot bar of the tilt-in window via a vertical drop-in installation, the cam being rotatable within the aperture between a locked position and an unlocked position, the cam having a second slot that is aligned with the vertically extending first slot when the cam is in the locked position allowing the pivot bar to move between the vertically extending first slot and the second slot of the cam, the first projection extending into the vertically extending first slot and intersecting a vertical centerline of the aperture, the first projection directly engaging the second portion of the first spring.

2. The counterbalance assembly of claim 1, wherein the second slot of the cam includes a longitudinal axis that is substantially collinear with a vertical centerline of at least a portion of the vertically extending first slot when the cam is in the locked position.

3. The counterbalance assembly of claim 1, wherein the vertically extending first slot includes an opening that is partially defined by the first projection, the first opening having vertical centerline that is laterally offset from a longitudinal axis of the second slot when the cam is in the locked position, and wherein the first slot includes a portion that is disposed at an angle relative to the longitudinal axis of the second slot when the cam is in the locked position.

4. The counterbalance assembly of claim 1, wherein a distal end of the first projection includes a lip that is vertically aligned with the second slot when the cam is in the locked position.

5. The counterbalance assembly of claim 1, wherein the longitudinal axis of the second slot of the cam is not aligned with the vertically extending slot when the cam is in the unlocked position, thereby restricting the pivot bar from moving between the vertically extending first slot and the second slot of the cam when the cam is in the unlocked position.

6. The counterbalance assembly of claim 1, wherein the carrier assembly further includes a horizontally extending slot disposed perpendicular to the vertically extending slot and in communication with the vertically extending slot, the horizontally extending slot receiving a lock that is configured to engage the jamb channel when the cam is in the locked position to restrict the carrier assembly from moving vertically in the window jamb channel.

7. The counterbalance assembly of claim 6, wherein the lock includes a center member interconnecting a first member and a second member, the first member having a first outer surface and the second member having a second outer surface, the center member configured to expand as the cam is moved into the locked position such that the first and the second members move apart from one another and the first and the second outer surfaces engage the jamb channel to restrict the carrier assembly from moving vertically in the jamb channel, the center member further configured to resiliently contract as the cam is moved into the unlocked position such that the first and the second members move towards one another and the first and the second outer members to allow the carrier assembly to move in the jamb channel.

8. A window counterbalance system for a tilt-in window having a pivot bar, the window counterbalance system and the tilt-in window installed in a window jamb, the window counterbalance system comprising:

a bracket fixedly mounted to the jamb channel;

a first spring having a first portion and a second portion, the first portion of the the first spring coupled to the bracket; and a carrier assembly having a vertically first extending slot, an aperture in communication with the vertically extending slot, a cam having a rotational axis and rotatably engaging the aperture, a first projection, extending inwardly toward a centerline of the vertically extending first slot, and a second projection, extending inwardly toward the centerline of the vertically extending slot the vertically extending first slot adapted to receive the pivot bar of the tilt-in window via a vertical drop-in installation, the cam configured to rotate within the aperture between a locked position and an unlocked position, the cam having a second slot in communication with the vertically extending first slot when the cam is in the locked position to allow the pivot bar to move between the vertically extending slot and the second slot of the cam, the first projection having a first distal end and the second projection having a second distal end, the first and the second distal ends facing one another and defining a gap therebetween, the gap being vertically aligned with a vertical centerline of the aperture and in communication with the vertically extending first slot, and wherein one of first projection and the second projection directly engages the second portion of the spring.

9. The window counterbalance system of claim 8, wherein the second slot of the cam is not aligned with the vertically extending slot when the cam is in the unlocked position, thereby restricting the pivot bar from moving between the vertically extending slot and the second slot of the cam when the cam is in the unlocked position.

10. The window counterbalance system of claim 8, wherein the carrier assembly includes a horizontally extending slot disposed perpendicular to the vertically extending slot, the horizontally extending slot is in communication with the vertically extending slot, the horizontally extending slot receiving a lock therein, the lock configured to engage the window jamb when the cam is in the locked position to restrict the carrier from moving vertically in the window jamb.

11. A window counterbalance system for a tilt-in window having a pivot bar, the window counterbalance system and the tilt-in window installed in a window jamb, the window counterbalance system comprising:

a bracket fixedly mounted to the jamb channel;

a first spring having a first portion and a second portion, the first portion of the first spring coupled to the bracket; and a carrier assembly having a vertically extending first slot, an aperture in communication with the vertically extending first slot, a cam having a rotational axis and rotatably engaging the aperture, and a projection, the vertically extending first slot adapted to receive the pivot bar of the tilt-in window via a vertical drop-in installation, the cam configured to rotate within the aperture between a locked position and an unlocked position, the cam having a second slot in communication with the vertically extending first slot when the cam is in the locked position to allow the pivot bar to move between the vertically extending first slot and the second slot of the cam, the projection extending into a first portion of the vertically extending first slot, the first portion having a longitudinal axis that is offset from a longitudinal axis of the second slot when the cam is in the locked position, the vertically extending first slot including a second portion vertically aligned with and directly adjacent the second slot when the cam is in the locked position and a third portion that connects the first and second portions and that is disposed at an angle relative to the longitudinal axis of the second slot when the cam is in the locked position wherein the longitudinal axis of the second slot of the cam is substantially collinear with a vertical centerline of the second portion of the vertically extending first slot and is substantially parallel with and offset from vertical centerline of the first portion of the vertically extending slot when the cam is in the locked position.

12. The counterbalance assembly of claim 11, wherein at least a portion of the projection intersects the longitudinal axis of the second slot of the cam when the cam is in the locked position.

13. The counterbalance assembly of claim 11, wherein a distal end of the projection includes a lip that intersects a vertical centerline of the aperture.

14. The counterbalance assembly of claim 11, wherein the longitudinal axis of the second slot of the cam is not aligned with the vertically extending first slot when the cam is in the unlocked position, thereby restricting the pivot bar from moving between the vertically extending first slot and the second slot of the cam when the cam is in the unlocked position.

15. The counterbalance assembly of claim 11, wherein the carrier assembly further includes a horizontally extending slot in communication with the aperture, the horizontally extending slot receiving a lock that is configured to engage the jamb channel when the cam is in the locked position to restrict the carrier assembly from moving vertically in the window jamb channel.

16. The counterbalance assembly of claim 15, wherein the lock includes a center member interconnecting a first member and a second member, the first member having a first outer surface and the second member having a second outer surface, the center member configured to expand as the cam is moved into the locked position such that the first and the second members move apart from one another and the first and the second outer surfaces engage the jamb channel to restrict the carrier assembly from moving vertically in the jamb channel, the center member further configured to resiliently contract as the cam is moved into the unlocked position such that the first and the second members move towards one another and the first and the second outer members to allow the carrier assembly to move in the jamb channel.

* * * * *